US005765316A

United States Patent [19]

Kavarsky

[11] Patent Number: 5,765,316

[45] Date of Patent: Jun. 16, 1998

[54] BUILDING MODULE, COLLAPSIBLE FOR TRANSPORT AND EXPANDABLE FOR USE

[76] Inventor: Raymond R. Kavarsky, 1502 Farmington Ave., Berlin, Conn. 06037

[21] Appl. No.: 715,020

[22] Filed: Sep. 17, 1996

[51] Int. Cl.[6] ..... E04B 1/344

[52] U.S. Cl. ..... 52/67; 52/79.5; 52/79.1; 52/69; 52/68; 52/143; 52/234

[58] Field of Search ..... 52/79.5, 79.1, 52/79.7, 143, 234, 67, 69, 64, 68

[56] References Cited

U.S. PATENT DOCUMENTS

| | | | |
|---|---|---|---|
| 3,217,366 | 11/1965 | Wenger | 52/143 X |
| 3,348,344 | 10/1967 | Tatevossian . | |
| 3,633,324 | 1/1972 | Cuylits | 52/79.5 X |
| 3,719,386 | 3/1973 | Puckett et al. | 52/67 X |
| 3,736,708 | 6/1973 | Chapman . | |
| 3,890,747 | 6/1975 | Van Der Lely . | |
| 3,971,185 | 7/1976 | Hendrich . | |
| 4,070,804 | 1/1978 | Van Der Lely . | |
| 4,242,846 | 1/1981 | Hurd et al. | 52/64 X |
| 4,534,141 | 8/1985 | Fagnoni | 52/68 |
| 4,603,518 | 8/1986 | Fennes | 52/79.5 X |
| 4,633,626 | 1/1987 | Freeman et al. . | |
| 4,660,332 | 4/1987 | Colvin, Jr. . | |
| 4,689,924 | 9/1987 | Jurgensen | 52/67 |
| 4,741,133 | 5/1988 | Kutzner | 52/79.5 |
| 4,779,514 | 10/1988 | Prigmore et al. | 52/79.5 |
| 4,829,726 | 5/1989 | de Potter d'Indoye | 52/64 X |
| 4,891,919 | 1/1990 | Palibroda . | |
| 4,958,874 | 9/1990 | Hegedus | 52/79.5 X |
| 5,094,059 | 3/1992 | Ganescu . | |
| 5,209,030 | 5/1993 | Sloditskie et al. . | |
| 5,237,784 | 8/1993 | Ros | 52/79.5 |
| 5,381,633 | 1/1995 | Hendrich . | |
| 5,444,944 | 8/1995 | Roelofsz . | |
| 5,447,000 | 9/1995 | Larsen . | |
| 5,491,934 | 2/1996 | Bigelow, Jr. et al. . | |
| 5,596,844 | 1/1997 | Kalinowski | 52/79.5 |

*Primary Examiner*—Wynn E. Wood
*Attorney, Agent, or Firm*—McCormick, Paulding & Huber

[57] ABSTRACT

A building module collapsible for transport and expandable for use, includes an elongated core section which has substantially vertical, lateral and longitudinal walls and a core floor section which together define a partially enclosed interior area. A floor assembly is connected to the core floor section for movement between folded and unfolded positions. Telescopic, as well as foldable wall, ceiling, floor and roof sections are provided and allow the building module when in its collapsed for transport condition to comply with the current United States Department of Transportation regulations pertaining to the maximum shipping sizes for standard ground transportation, as well as the current International Standards Organization codes pertaining to maximum shipping sizes for standard ground and water transportation. In addition, the partially enclosed interior area can be used, when the building module is in the collapsed for transport condition, as a storage area for walls, doors, windows and other building materials used in the construction process.

36 Claims, 14 Drawing Sheets

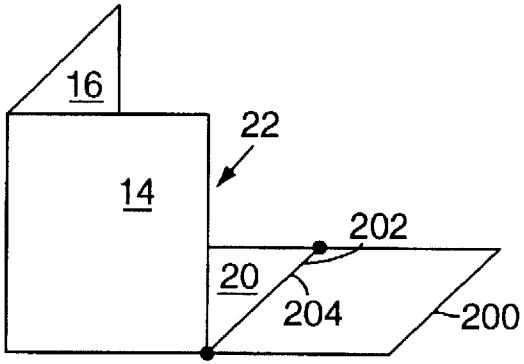
FIG. 9
FIG. 10
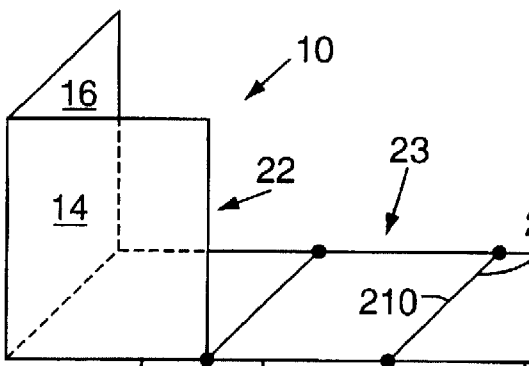
FIG. 11
FIG. 12

BUILDING MODULE, COLLAPSIBLE FOR TRANSPORT AND EXPANDABLE FOR USE

FIELD OF THE INVENTION

The present invention relates generally to portable modular buildings, and more specifically to building modules.

BACKGROUND OF THE INVENTION

The present invention has particular utility in the erection of buildings from building modules which when in their collapsed for transport condition are of a size and shape capable of shipment via standard transportation means, and is described herein as applied to such use.

Modular construction has become a popular method of erecting homes and other buildings. Typically, a modular dwelling consists of several sections, or modules, which constitute the various portions of the particular facility. For example, if a modular house were being built, one module may constitute the first half of the first floor, another, the second half, and yet another, the first half of the second floor. In known modular type construction, the individual prefabricated modules are usually provided with all of the necessary plumbing, fixtures, wiring and siding pre-installed. Additionally, the interior walls as well as exterior windows and doors are also installed prior to shipment of the module to the construction site.

Shipping the previously described modules to a construction site can pose difficulties. This is due to the fact that the individual modules are very large and require transportation means specially adapted to convey them. As a result of the necessity for special transportation means, permits are often required to move the modular sections and these permits can be quite expensive. The problem is compounded when the modules must be shipped across several states where permits are required for each state. In addition, transporting the modules to remote locales may be precluded by the inaccessibility of the roads to the special vehicles needed to convey the modules. This being the case, manufacturers of modular homes typically service readily accessible areas within a certain radius (usually 150 miles) from the factory where the modules are fabricated.

In addition to the foregoing, due to the fact that there are generally size limitations which must be complied with when employing international transportation means, known modules cannot be readily shipped to foreign locations. Additionally, the type of construction methods and materials employed in modules of the known type cannot withstand many foreign climates, and are often inconsistent with the local building codes of many international locales.

Frequently, a need arises for a large number of dwellings to be rapidly erected in a given locale. These requirements can be foreign or domestic, and are often the result of natural disasters such as floods or earthquakes, and in some instances war. In these exigencies, rapid response is critical. Known modular dwellings are usually constructed on an as required basis and are not inventoried. Moreover, due to their size and manner of construction, they are somewhat fragile and cannot withstand the rigors of international shipment.

As described above, known modular construction utilizes finished modules herein both the interior and exterior are assembled in substantially their final form at he factory. As such, they cannot be shipped in an economically efficient manner. This results from the fact that shipping charges are based in large part by the amount of space occupied by what is being shipped. Because modules of the known type are pre-assembled and therefore contain a large amount of empty interior space, the purchaser is paying shipping charges for the unoccupied space within the module (e.g. the purchaser is paying for the "shipment of air").

States and municipalities very often undertake construction projects for low income housing on state-owned land. In general the need for this type of housing is immediate and therefore the construction must progress expeditiously. Moreover, states and municipalities strongly prefer construction projects which will employ local craftsman. Because the modules of the known type are completely pre-assembled, the construction process allows for little or no interaction with community craftsman.

Based on the foregoing, it is the general object of the present invention to provide a collapsible modular dwelling which can be shipped both domestically and internationally via conventional standard transportation means.

It is an additional object of the present invention to supply a building module wherein the materials necessary to complete the construction can be shipped within the collapsed module such that the purchaser is not paying for the "shipment of air", thereby keeping the overall price of construction to a minimum.

It is a further object of the present invention to supply a collapsible dwelling wherein the shell of the dwelling can be erected and made weather tight in a very short period of time.

It is still a further object of the present invention to supply building modules capable of easily complying with the various domestic and international building codes.

Finally, it is an object of the present invention to provide building modules whereby specially skilled labor is not needed during the erection process.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein:

FIG. 9 is a schematic representation of the an alternate embodiment of the building module of FIG. 1 in the folded position;

FIG. 10 is a schematic representation of the building module of FIG. 9 in the unfolded position;

FIG. 11 is a schematic representation of an alternate embodiment of the building module of FIG. 1 having an additional movable floor section, shown in the folded position;

FIG. 12 is a schematic representation of the building module of FIG. 11 shown in the unfolded position;

DETAILED DESCRIPTION OF THE PREFERRED EMBODIMENTS

Figure 1:
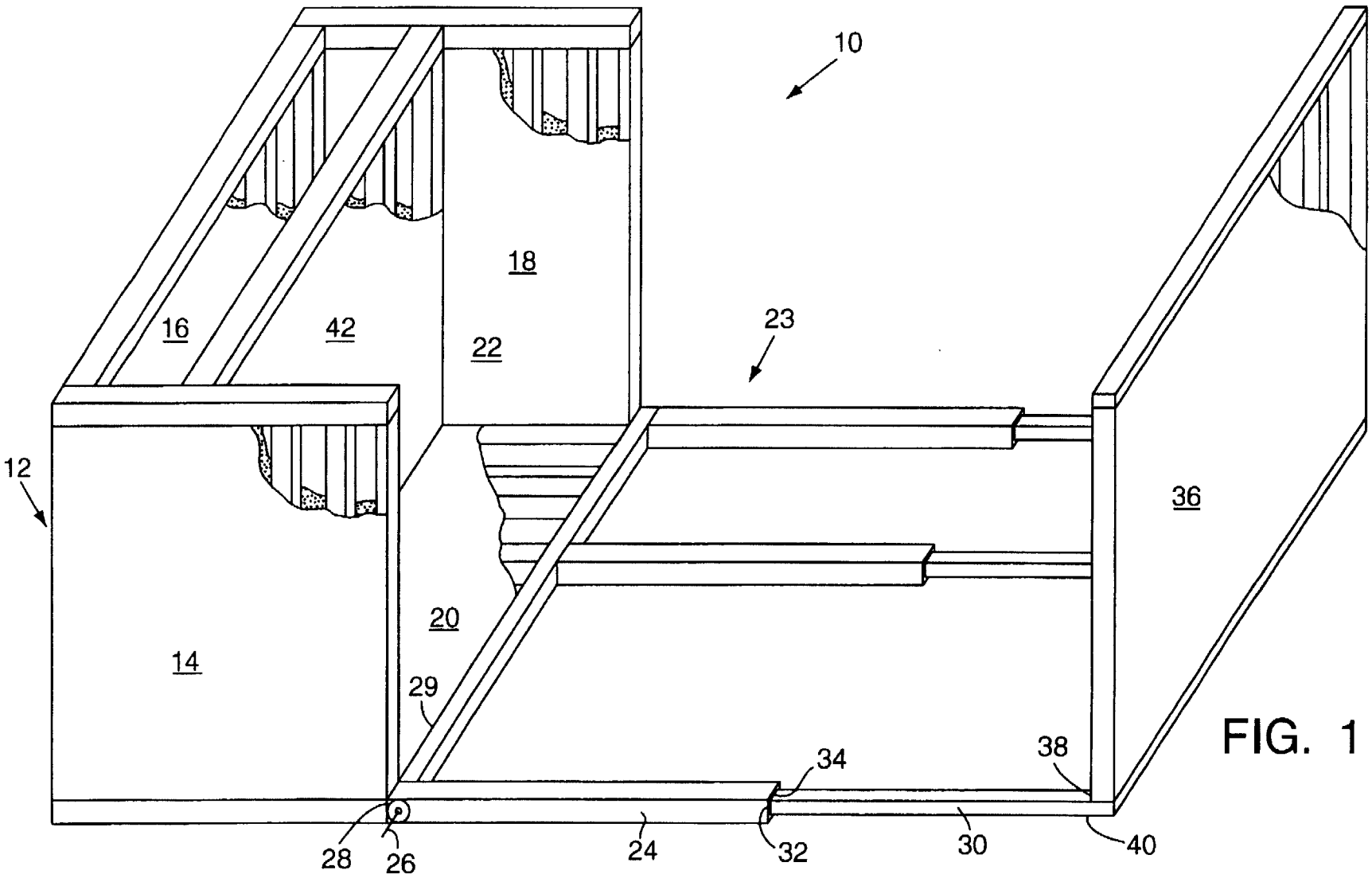
FIG. 1 is a perspective view of the building module of the present invention shown in its unfolded position.

The present invention will be described with reference to the orientation of the building module 10 as depicted in FIG. 1 with the understanding that the terms vertical, horizontal, front, rear, longitudinal, and lateral are relative when interpreting the scope of the claims as presented hereinafter. Turning to the drawings and first referring to FIG. 1, the preferred embodiment of a building module which is collapsible for transport and expandable for use is there shown and generally designated as 10.

Figure 2:
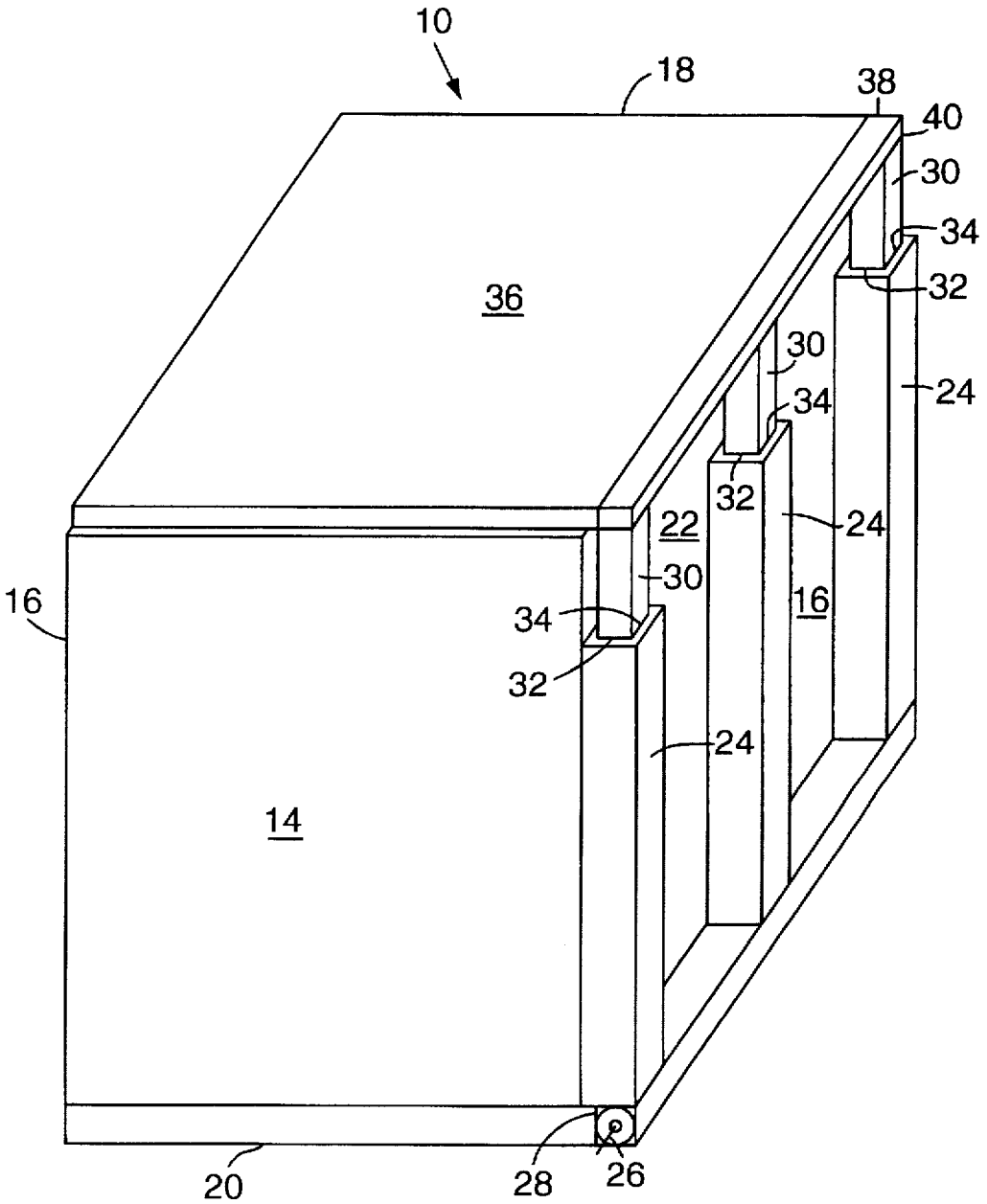
FIG. 2 is a perspective view of the building module of the present invention shown in its folded position.

Referring to FIGS. 1 and 2, the building module 10 is comprised of a substantially rigid elongated core structure 12 having a vertical longitudinal wall sections 14, and 18. A vertical lateral wall section 16 is interposed between and connected to the front and rear wall sections 14 and 18. All of the vertical wall sections 14, 16 and 18 are connected to a substantially horizontal core floor section 20, thereby defining a partially enclosed interior area 22. An expandable floor assembly, generally designated 23, is in communication with the core floor section 20 for movement between a contracted and an extended position.

Still referring to FIGS. 1 and 2, in a first preferred embodiment, the expandable floor assembly 23 comprises, a movable floor section 24, pivotally attached along an edge portion 28 to an edge portion 29 of the core floor section 20 for movement about a pivot axis 26 between a folded position, FIG. 2, and an unfolded position FIG. 1. The movable floor section 24 being substantially vertical, and perpendicular to the core floor section 20 in the folded position, FIG. 2, and substantially in a common plane with, the core floor section 20 in the unfolded position, FIG. 1.

In the first preferred embodiment of the present invention, the expandable floor assembly 23 also includes a telescopic floor section 30 which is slidably engaged with the movable floor section 24 for movement between a retracted position, FIG. 2, and an extended position, FIG. 1. Therefore, when the movable floor section 24 is in the folded position, FIG. 1, the telescopic floor section is in the retracted position.

Continuing to refer to FIGS. 1 and 2, a substantially vertical wall section 36 is attached along an edge portion 38 to an edge portion 40 of the telescopic floor section 30. The substantially vertical wall section 36 being substantially perpendicular to the telescopic floor section 30 thereby permitting the substantially vertical wall section 36 to be supported by the core section vertical walls 14, 16 and 18 when the telescopic floor section 30 is in the retracted position and the movable floor section 24 is in the folded position, FIG. 2.

As can be best seen in FIG. 1, wall section 42 can be stored for shipment within the partially enclosed interior area 22 when the building module 10 is collapsed for transport, such that it can be removed from the partially enclosed interior area and assembled between a respective one of the core section longitudinal walls 14 and 18, and the substantially vertical wall section 36 when the building module 10 is in the expanded position.

Turning now to FIG. 2, the building module 10 is there shown in its "collapsed for transport" condition. In this condition, the building module of the present invention as described above as well as in any of the preferred embodiments described hereinafter, complies with the current United States Department of Transportation regulations regarding the maximum standard allowable shipping size for ground transportation. Additionally, the present invention can also comply with the current International Standard's Organization codes regarding the standard shipping sizes for ground and water transport. Compliance with these regulations and codes obviates the need for any non-standard transportation means.

Figure 3:
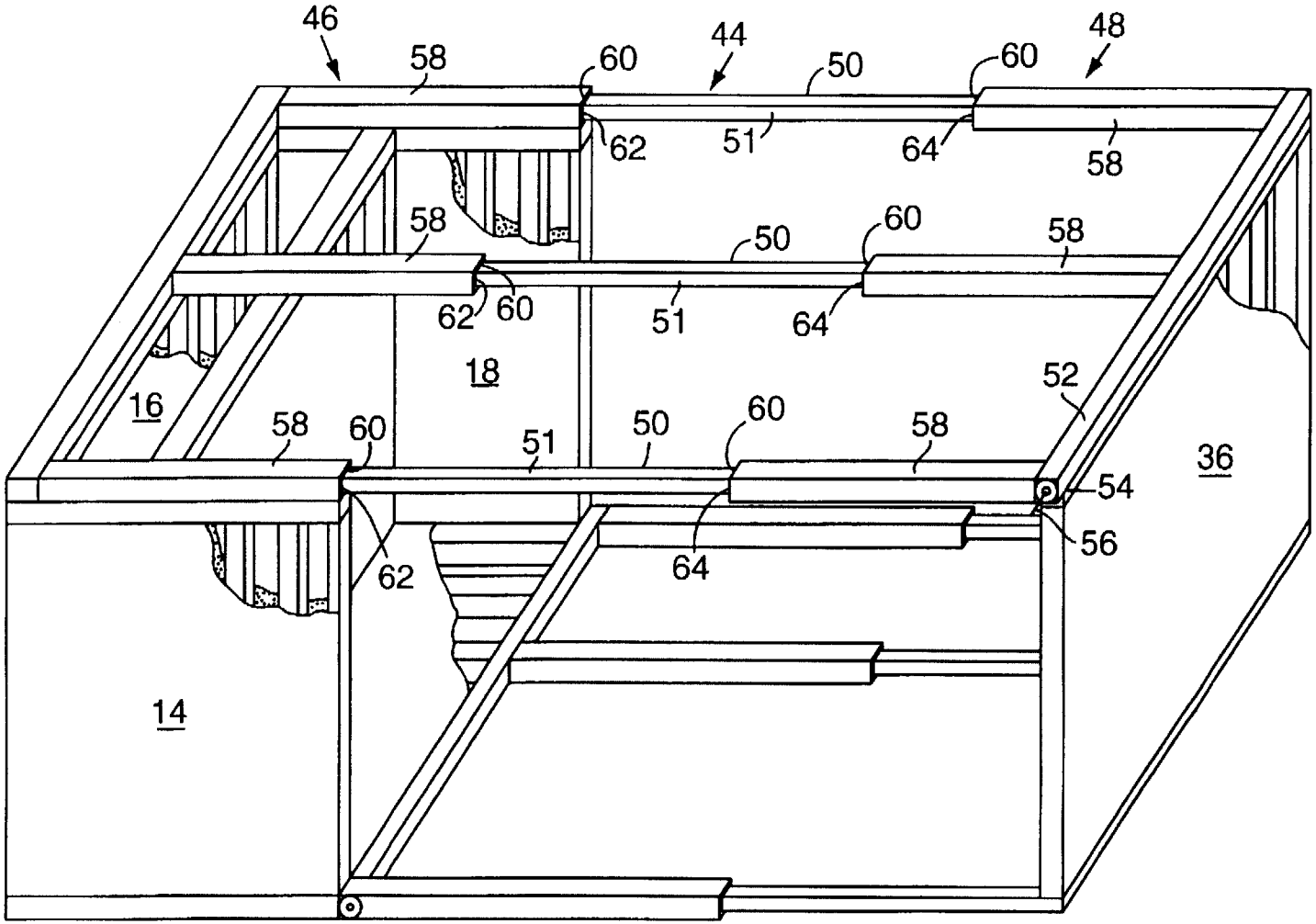
FIG. 3 is a perspective view of the building module of the present invention shown in its unfolded position and having a telescopic floor and ceiling.
Figure 4:
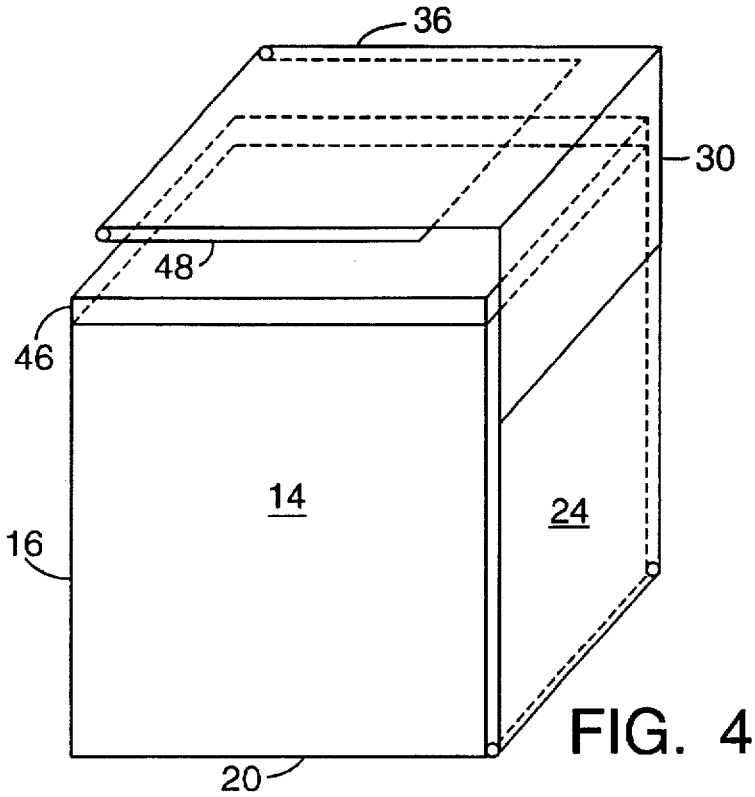
FIG. 4 is a perspective view of the building module of FIG. 3 in its folded position.

Turning next to FIGS. 3 and 4, the building module 10 is shown in its unfolded, FIG. 3, and its folded, FIG. 4, positions. In this embodiment of the present invention, a telescopic ceiling generally designated as 44, is comprised of a first ceiling section 46, a second ceiling section 48, and a plurality of telescopic ceiling members 50 having shaped external surface 51.

Referring to FIG. 3, the first ceiling section 46 is shown connected to and supported by the core structure vertical walls 14, 16, and 18. The second ceiling section 48 is pivotally connected along an edge portion 52 to an edge portion 54 of the substantially vertical wall section 36 for movement about a pivot axis 56 between a folded position, FIG. 4 where the second ceiling section 48 is substantially parallel to and in a side-by-side relationship with the substantially vertical wall section 36, and an unfolded position, FIG. 3, where the second ceiling section 48 is substantially perpendicular to the substantially vertical wall section 36. When the building module 10 is collapsed for transport, the second ceiling section 48 and the substantially vertical wall section 36 are in a superposed relationship with the first ceiling section 46.

Both the first ceiling section 46 and the second ceiling section 48 are comprised of a plurality of ceiling joists 58 formed from a suitable material such as, but not limited to metal. The ceiling joists 58 have an interior surface 60 defining an interior area shaped to slidably receive the exterior surfaces 51 of the telescopic ceiling members 50 for movement between a retracted position, FIG. 4, wherein the telescopic ceiling members 50 are positioned within the ceiling joists 58 of the first ceiling section 46, and an extended position, FIG. 3, where the telescopic ceiling members 50 are interposed between and slidably engaged with a first end 62 of the first ceiling section and a second end 64 of the second ceiling section.

Figure 6:
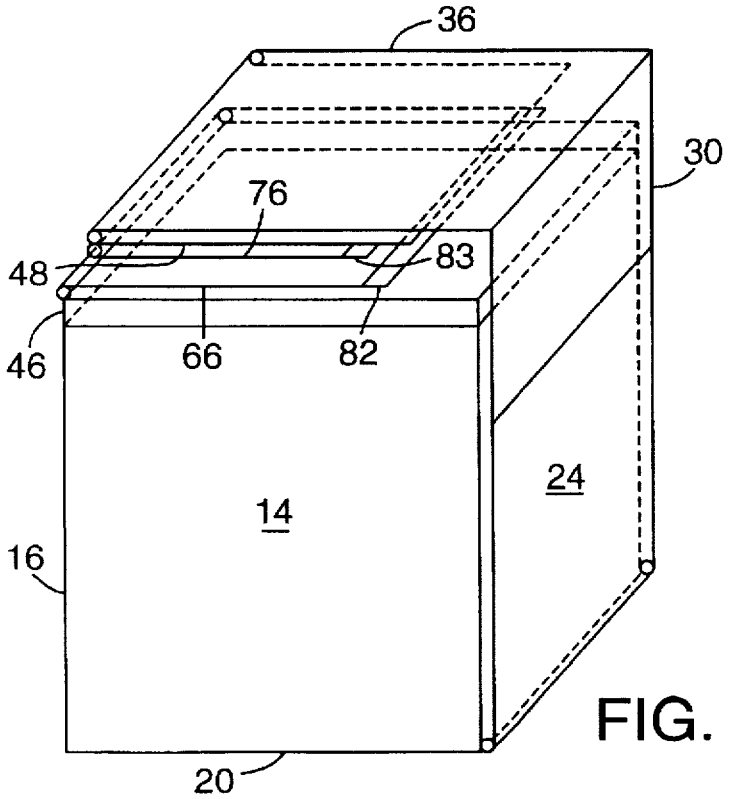
FIG. 6 is a perspective view of the building module of FIG. 5 showing the foldable roof in its folded position.
Figure 5:
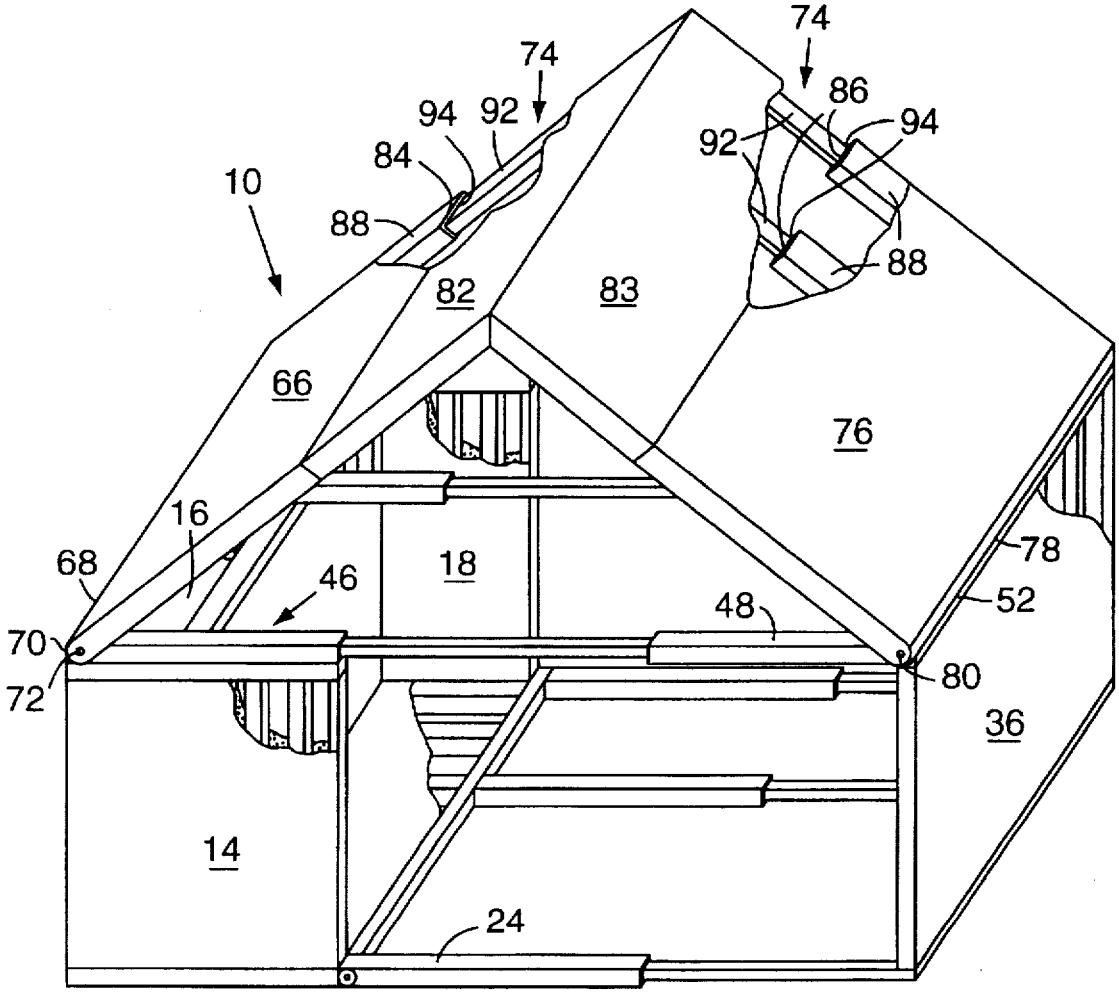
FIG. 5 is a perspective view of the building module of the present invention having a foldable roof in its unfolded position.

Turning next to FIGS. 5 and 6, the building module 10 further includes a pitched roof 74 comprised of a first roof section 66 pivotally connected at along an edge portion 68 to an edge portion 70 of the first ceiling section 46 for movement about an axis 72 between a collapsed position, FIG. 6, where the first roof section 66 is supported by the first ceiling section 46, and an assembled position, FIG. 5. A second roof section 76 is also pivotally connected along an edge portion 78 to edge portion 52 of the second ceiling section 48 for movement about a pivot axis 80 between an assembled position, FIG. 5, where the second roof section 76 forms a portion of the pitched roof, and a collapsed position, FIG. 6, where the second roof section 76 is supported by the second ceiling section 48 such that when the movable floor section 24 is in the folded position the first and second ceiling sections 46, 48, the first and second roof sections 66, 76, and the substantially vertical wall section 36 all lie flat in a superposed relationship supported by the core structure vertical walls 14, 16 and 18.

Still referring to FIGS. 5 and 6, the pitched roof 74 may also include first and second telescopic roof sections 82 and 83. The first telescopic roof section 82 is slidably engaged with the first roof section 66 for movement between a retracted position, FIG. 6, and an extended position, FIG. 5. Similar to the first telescopic roof section 82, the second telescopic roof section 83 is slidably engaged with the second roof section 76 for movement between a retracted position, FIG. 6, and an extended position, FIG. 5. Therefore, when the telescopic roof sections 82 and 83, are in their respective extended positions and the first and second roof sections 66 and 76, are in their respective assembled positions, the pitched continuous roof 74 is formed.

Still referring to FIG. 5, the first and second roof sections 66 and 76 are each comprised of a plurality of rafters 88 formed from a suitable material, such as, but not limited to metal. Similarly, the first and second telescopic roof sections 82 and 83, include a plurality of telescopic rafter members 90 having an exterior surface 92, also formed from a suitable material such as, but not limited to metal. The rafters 88 have an interior surface 94 defining an interior area shaped to slidably receive the telescopic rafter member exterior surfaces 92.

FIG. 6 shows the building module of FIG. 5 in its collapsed for transport condition. In this condition, the telescopic roof sections 82 and 83 are in their retracted positions.

Figure 7:
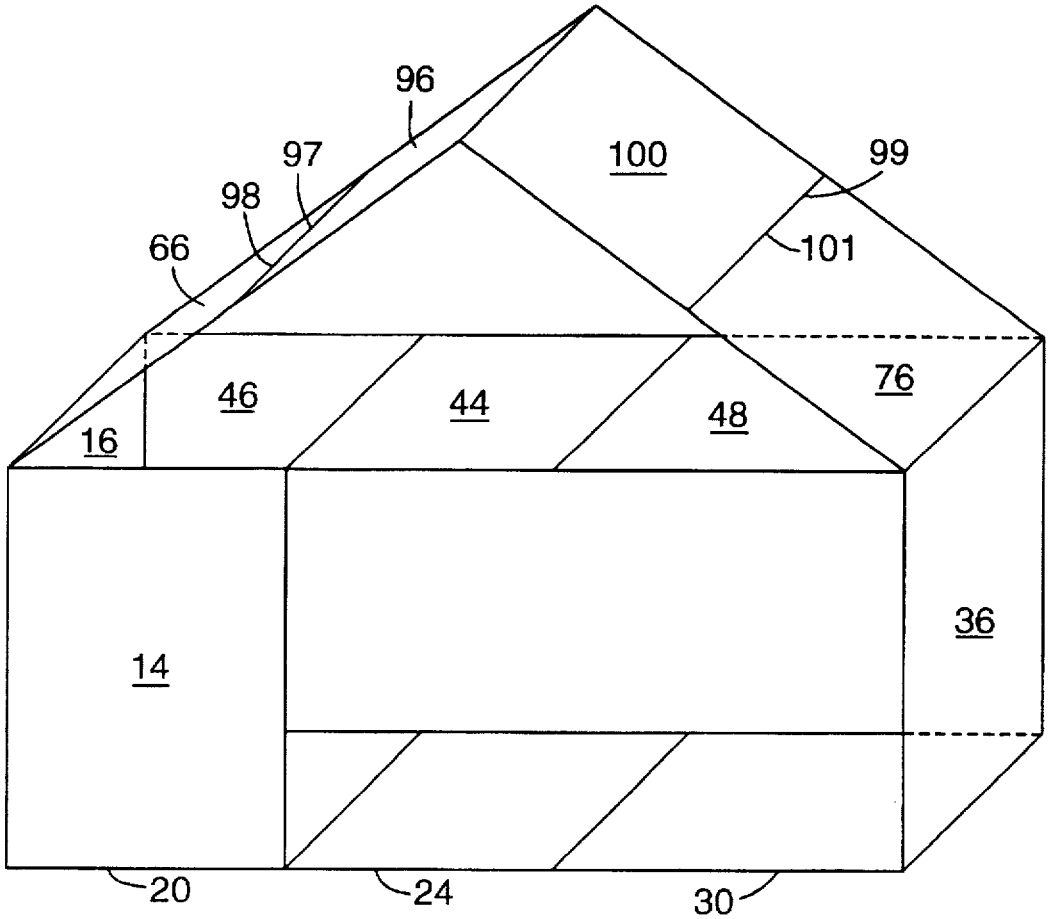
FIG. 7 is a schematic representation of an alternate embodiment of the building module of FIG. 5, in the unfolded position.
Figure 8:
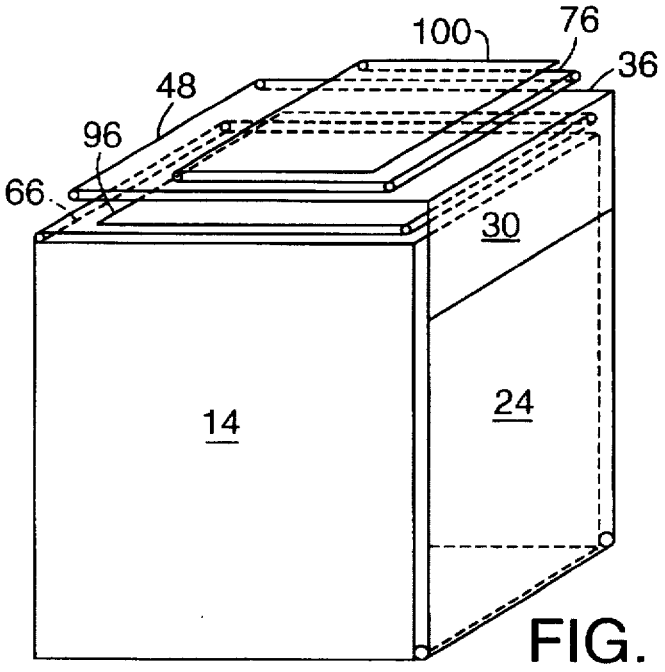
FIG. 8 is a schematic representation of the building module of FIG. 7, in the folded position.

In yet a further embodiment of the present invention shown in FIGS. 7 and 8, the building module 10, instead of having the previously described telescopic roof sections, includes a third roof section 96 pivotally connected along an edge portion 97 to an edge portion 98 of the first roof section 66 for movement about a pivot axis 100 between an assembled position, FIG. 7, and a collapsed position, FIG. 8. When in the collapsed position, the third roof section assumes a side-by-side substantially parallel position with regard to the first roof section 66. Similar to the third roof section 96, a fourth roof section 100 is also included and is pivotally connected along an edge portion 99 to an edge portion 101 of the second roof section 76 for movement about a pivot axis 102 between an assembled position, FIG. 7, and a collapsed position, FIG. 8. When the first, second, third and fourth roof sections 66, 76, 96, and 100 respectively, are in the assembled positions, FIG. 7, a pitched continuous roof 104 is formed. Conversely, referring to FIG. 8, when the roof sections are in the collapsed position, the fourth roof section 100 assumes a substantially parallel, side-by-side relationship with the second roof section 76 such that when the movable floor section 24 is in the previously described folded position, the first and second ceiling sections 46 and 48, the first, second, third, and fourth roof sections 66, 76, 96 and 100, and the substantially vertical wall section 36 are all in a superposed relationship supported by the core structure vertical walls 14, 16 and 18, thereby placing the building module 10 in its collapsed for transport condition.

Various other different versions of the building module of the present invention are possible, one such version is shown in FIGS. 9 and 10. Referring to these figures, the expandable floor assembly 23 includes a movable floor section 200 pivotally connected along an edge portion 202 to an edge portion 204 of the substantially horizontal core floor section 20 for movement between a folded, FIG. 9, and an unfolded, FIG. 10, position. When the movable floor section 200 is in the folded position it is located within the partially enclosed interior area 22 and assumes a superposed relationship with the substantially horizontal core floor section 20. When in the unfolded position, the movable floor section 200 lies in substantially a common plane with the core floor section.

FIGS. 11 and 12 illustrate an embodiment of the present invention where in addition to the movable floor section 200, the expandable floor assembly includes an additional movable floor section 206 pivotally connected along an edge portion 208 to an edge portion 210 of the movable floor section 200 for movement between a folded and an unfolded position. When the building module 10 is in its collapsed for transport condition, FIG. 11, both the movable and additional movable floor sections 200, 206 are in their respective folded positions and are located within the partially enclosed interior area 22 in a superposed relationship supported by the core floor section 20 .

Turning to FIG. 12, the building module is shown in its expanded condition with the core floor section 20, the movable floor section 200 and the additional movable floor section 206 being substantially a common plane.

Figure 14:
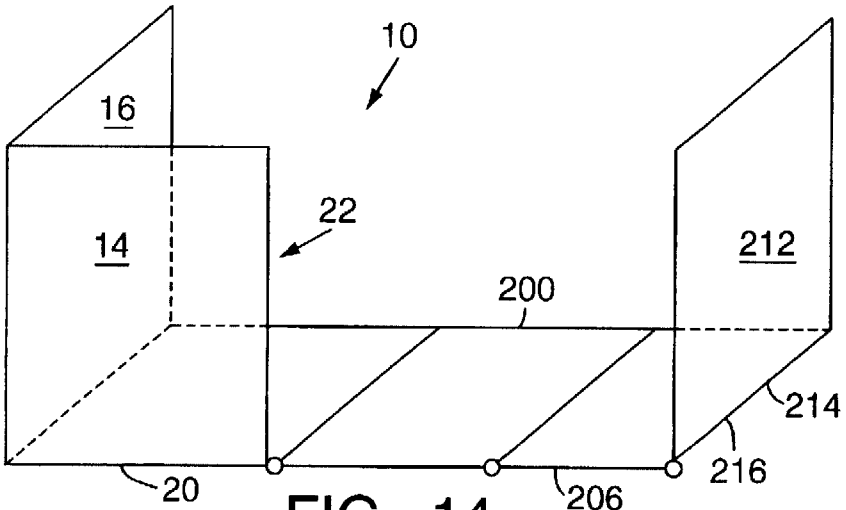
FIG. 14 is a schematic representation of the building module of FIG. 13, shown in the unfolded position.
Figure 13:
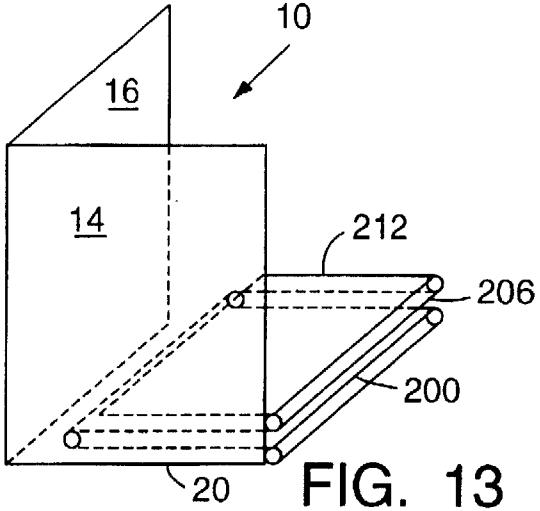
FIG. 13 is a schematic representation of the building module of FIG. 9, further including a movable vertical wall shown in the folded position.

Referring next to FIGS. 13 and 14, the building module 10 includes a vertical wall section 212 pivotally connected along and edge portion 214 to an edge portion 216 of the additional movable floor section 206, for movement between a folded position, FIG. 13 and an unfolded position, FIG. 14. When the building module 10 is in its collapsed for transport condition, the movable floor section 200, the additional movable floor section 206, and the at least one substantially vertical wall section 212 are in their respective folded positions and are located within the partially enclosed interior area 22 in a superposed relationship, and supported by the core floor section 20. The substantially vertical wall section 212 being substantially perpendicular to the additional movable floor section 206 when the floor sections 200 and 206 are in their respective unfolded positions, FIG. 14.

Figure 16:
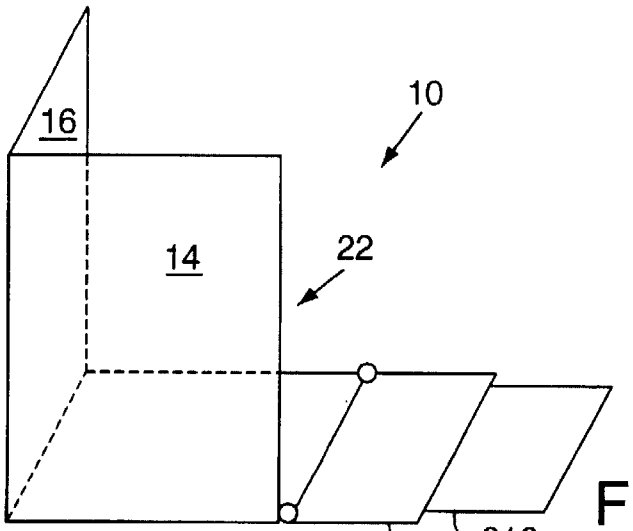
FIG. 16 is a schematic representation of the building module of FIG. 15, shown in the unfolded position.
Figure 15:
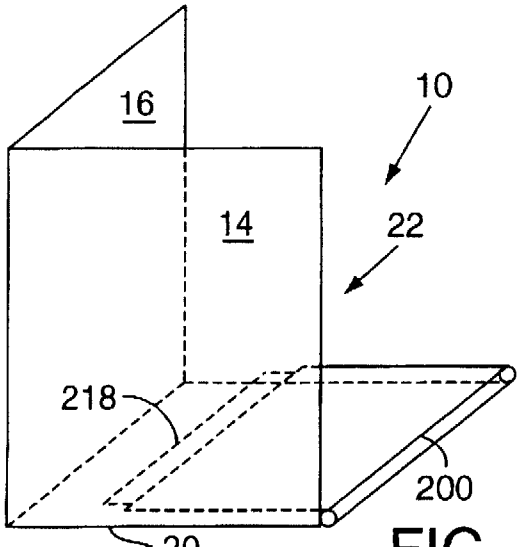
FIG. 15 is a schematic representation of the building module of FIG. 9, further including a telescopic floor section shown in the folded position.

As illustrated in FIGS. 15 and 16, instead of employing an additional movable floor section, a telescopic floor section 218 can be employed. As shown, telescopic floor section 218 is slidably engaged with movable floor section 200 for movement between a retracted position, FIG. 15, and an extended position FIG. 16. Therefore, when the building module 10 is in its collapsed for transport condition, both the telescopic floor section 218 and the movable floor section 200 are located within the partially enclosed interior area 22 and supported by the core floor section 20, FIG. 15. Conversely, when the building module 10 is in its expanded for use condition, FIG. 16, both the movable floor section 200 and the telescopic floor section 218 are substantially in a common plane with the core floor section 20.

Figure 18:
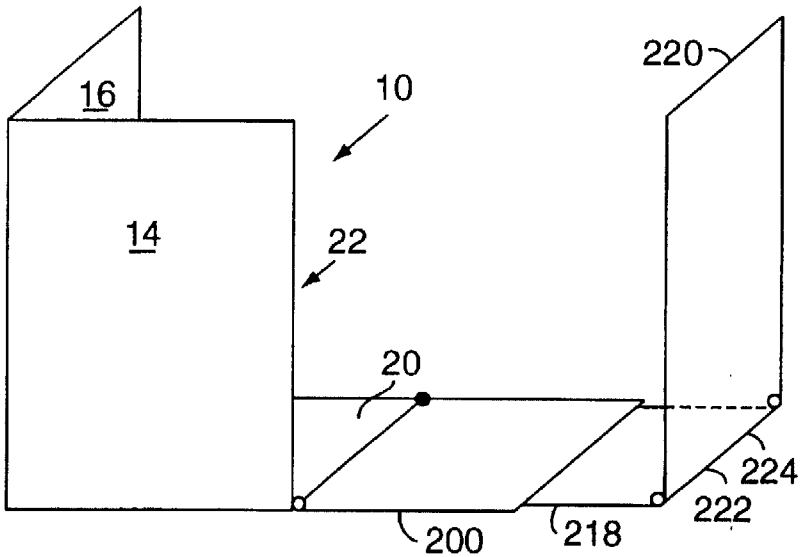
FIG. 18 is a schematic representation of the building module of FIG. 17, shown in the unfolded position.
Figure 17:
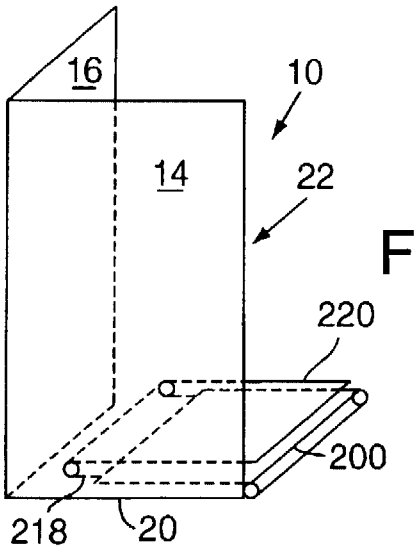
FIG. 17 is a schematic representation of the building module of FIG. 15, further including a movable vertical wall shown in the folded position.

In keeping with the present invention, FIGS. 17 and 18 show a substantially vertical wall section 220 pivotally attached along an edge portion 222 to an edge portion 224 of the telescopic floor section 218 for movement between a folded position, FIG. 17, and an unfolded position, FIG. 18. When the building module 10 is in its collapsed for transport condition, the telescopic floor section 218, the movable floor section 200 and the substantially vertical wall section 220 are located within the partially enclosed interior area 22 and supported by the core floor section 20, FIG. 15. Conversely, when the building module 10 is in its expanded for use condition, FIG. 16, both the movable floor section 200 and the telescopic floor section 218 are substantially in a common plane with the core floor section 20.

While FIGS. 9 through 18 show the floor and wall sections located in the partially enclosed interior area 22 and supported by the core floor section 20, the invention is not limited in this regard as the wall and floor section can also pivot under the core floor section 20 without departing from the broader aspects of the present invention.

Figure 19:
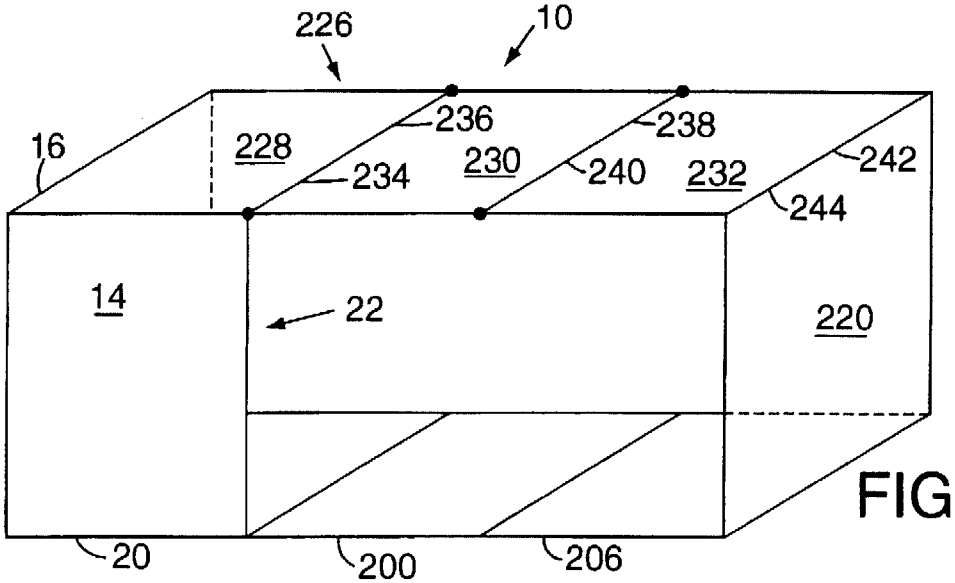
FIG. 19 is a schematic representation of the building module of FIG. 13 further including a foldable ceiling, shown in the unfolded position.
Figure 20:
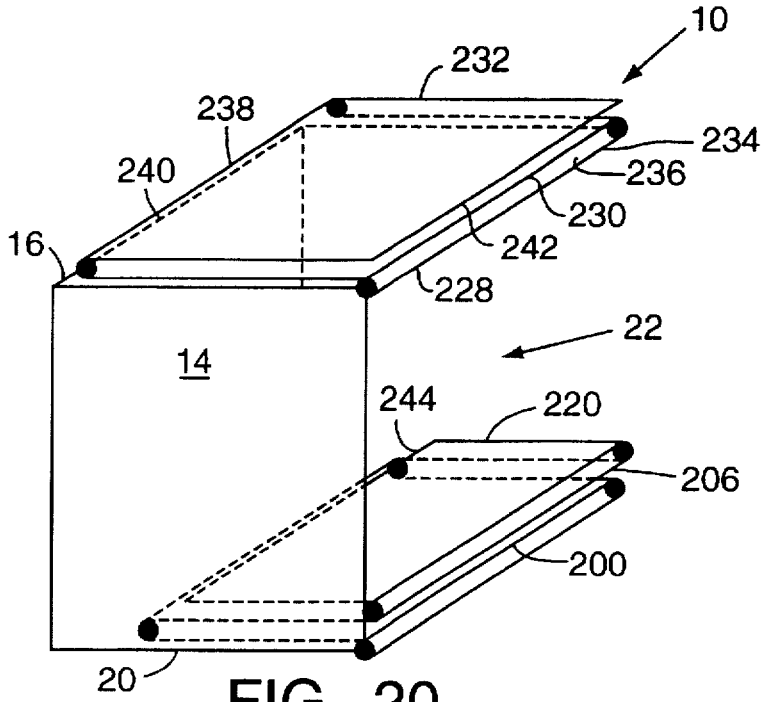
FIG. 20 is a schematic representation of the building module of FIG. 19 shown in the folded position.

Referring to FIGS. 19 and 20 the building module 10 of the present invention is therein shown having a ceiling generally designated as 226. Ceiling 226 consists of first, second, and third ceiling sections 228, 230 and 232. First ceiling section 228 is substantially horizontal and supported on the core section vertical walls 14 and 16. The second ceiling section 230 is pivotally connected along an edge portion 234 to an edge portion 236 of the first ceiling section 228 for movement between a folded position, FIG. 20, and an unfolded position, FIG. 19. Similarly to the second ceiling section 230, the third ceiling section 232 is pivotally connected along an edge portion 238 to an edge portion 240 of the second ceiling section 230 for movement between a folded and unfolded position. When the building module 10 is in its expanded for use condition, the ceiling sections are in the unfolded position and occupy a substantially common plane with the third ceiling section being supported along an edge portion 242 by an edge portion 244 on the substantially vertical wall 220.

Referring specifically to FIG. 20, the building module 10 is shown in the collapsed for transport condition with the previously described first, second, and third ceiling sections 228, 230, 232 in their respective folded positions and in a superposed relationship with one another, supported by the core section vertical walls 14, 16. Additionally, the aforementioned floor sections 200 and 206, as well as the substantially vertical wall section 220 are in their folded positions within the partially enclosed interior area thereby assuming a superposed relationship substantially parallel with and supported by the core floor section 20. While the floor sections 200 and 206, and the wall section 220 are shown and described as being within the partially enclosed interior area when in their respective folded positions, the invention is not limited in this regard as the floor and wall sections may also be pivoted below the core floor section when the building module is in the collapsed for transport condition, without departing from the broader aspects of the present invention.

Figure 21:
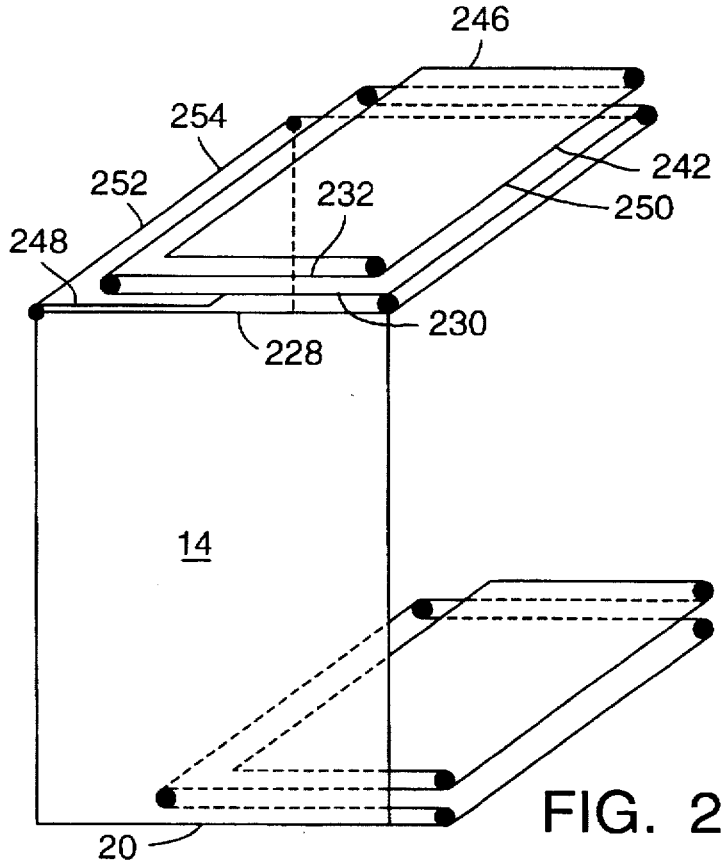
FIG. 21 is a schematic representation of the building module of FIG. 19 further including roof sections, shown in the folded position.
Figure 22:
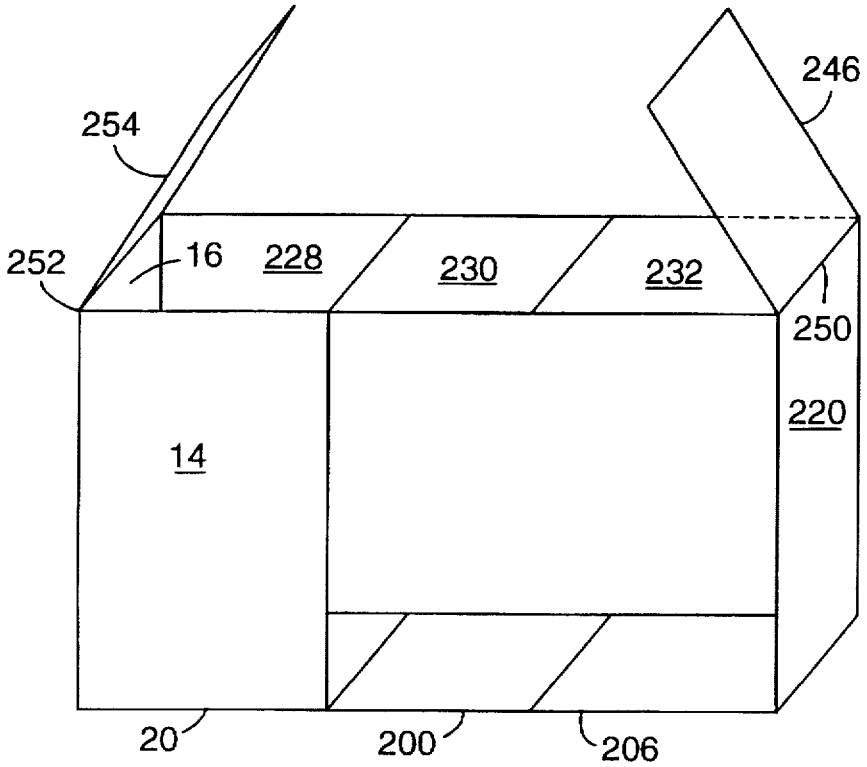
FIG. 22 is a schematic representation of the building module of FIG. 21 shown in the unfolded position.

Next turning to FIGS. 21 and 22, the building module 10 further includes first and second roof sections 248 and 250. First roof section 248 is pivotally connected along an edge portion 250 to edge portion 242 of the third ceiling section 232, for movement between a folded and an unfolded position. Second roof section 248 is pivotally connected along an edge portion 252 to edge portion 254 of the first ceiling section 228 for movement between a folded and an unfolded position.

FIG. 21 shows the building module 10 in the collapsed for transport condition with the second roof section 252 in its folded position lying in a superposed relationship with the first ceiling section 228. The second and third ceiling section 230 and 232, as well as the second roof section 250 are all also shown in FIG. 21 in their collapsed positions lying in a superposed relationship. All of the aforementioned roof and ceiling sections being supported by the core section vertical walls 14 and 16. Additionally, the floor sections 200 and 206 as well as vertical wall section 220 are in their respective folded positions. As previously described, while the floor and sections 200, 206, and 220 are shown lying in a superposed relationship parallel to and supported by the core floor section 20, the present invention is not limited in this regard as the floor and wall sections may also be pivoted under the core section such that they assume a parallel relationship with the core floor section 20.

Now turning to FIG. 22, as was described with reference to FIG. 19, the floor sections 200 and 206, the vertical wall section 220, and the ceiling sections 228, 230, and 232 are shown in their respective unfolded positions. In addition, the first and second roof sections 250 and 252 are also in their unfolded positions, each forming a portion of a pitched continuous roof.

Figure 23:
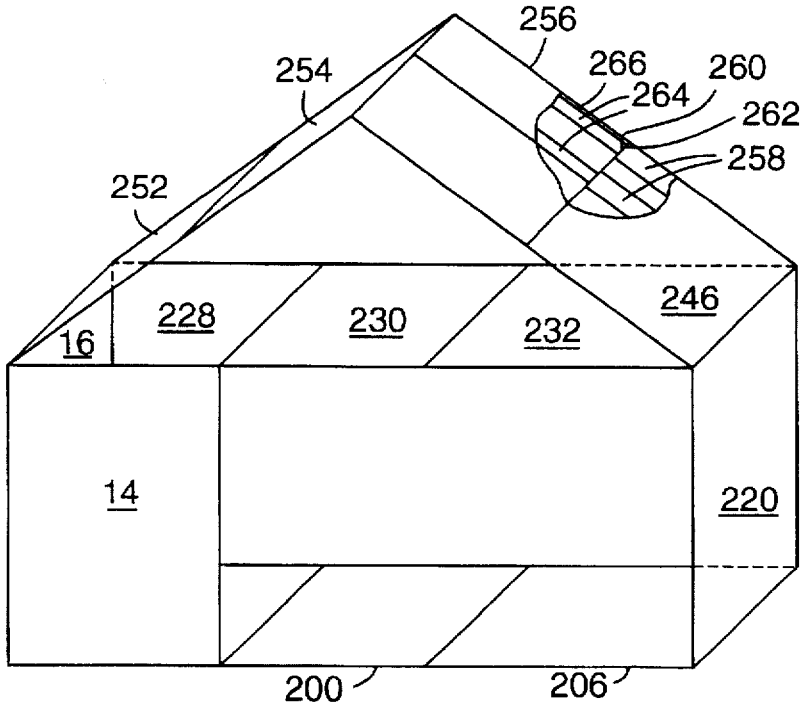
FIG. 23 is a schematic representation of an alternate embodiment of the building module of FIG. 21 shown in the folded position.
Figure 24:
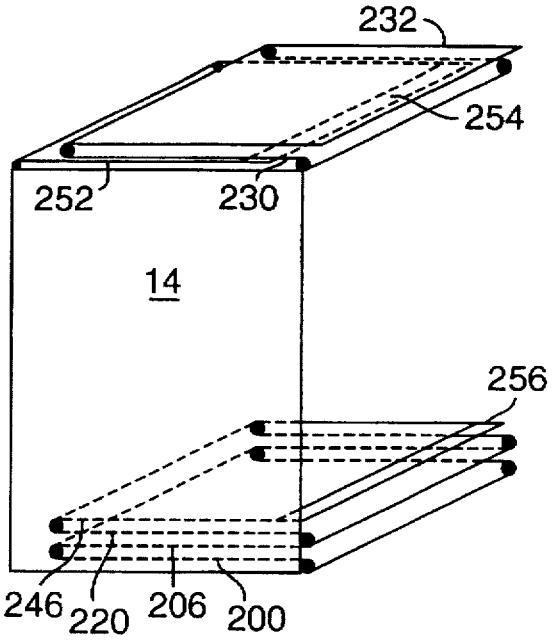
FIG. 24 is a schematic representation of the building module of FIG. 23 shown in the unfolded position.

Referring to FIGS. 23 and 24, the building module 10 includes a first and second telescopic roof section 254 and 256, slidably engaged with a respective one of the first and second roof sections 250 and 252, for movement between a retracted and an extended position. First and second roof sections 250 and 252 include a plurality of rafters 258 made of a suitable material such as, but not limited to metal. Similarly, the first and second telescopic roof sections 254 and 256 include a plurality of rafter members 264 made from a suitable material such as, but not limited to metal, having exterior surfaces 266. The rafters 258 include interior surface 260 which defines interior area 262 shaped to slidably receive the exterior surfaces 266 of the rafter members 264.

Accordingly, when the first and second roof sections 246 and 252 and the first and second telescopic roof sections 254 and 256 are in their respective unfolded positions, they coact to form a pitched continuous roof.

Figure 26:
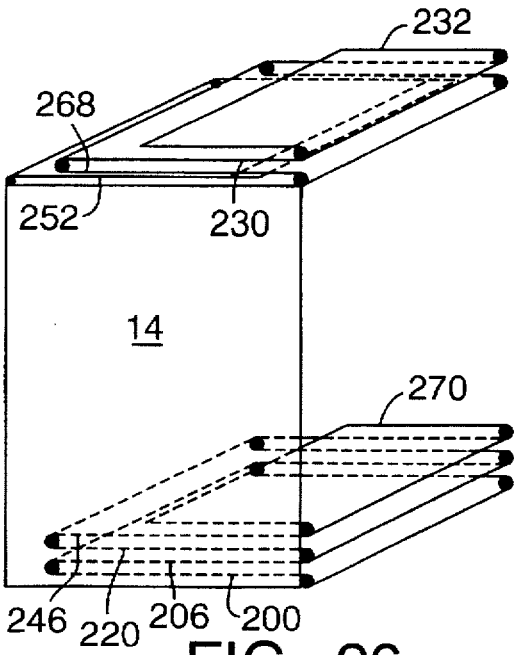
FIG. 26 is a schematic representation of the building module of FIG. 23 shown in the unfolded position.
Figure 25:
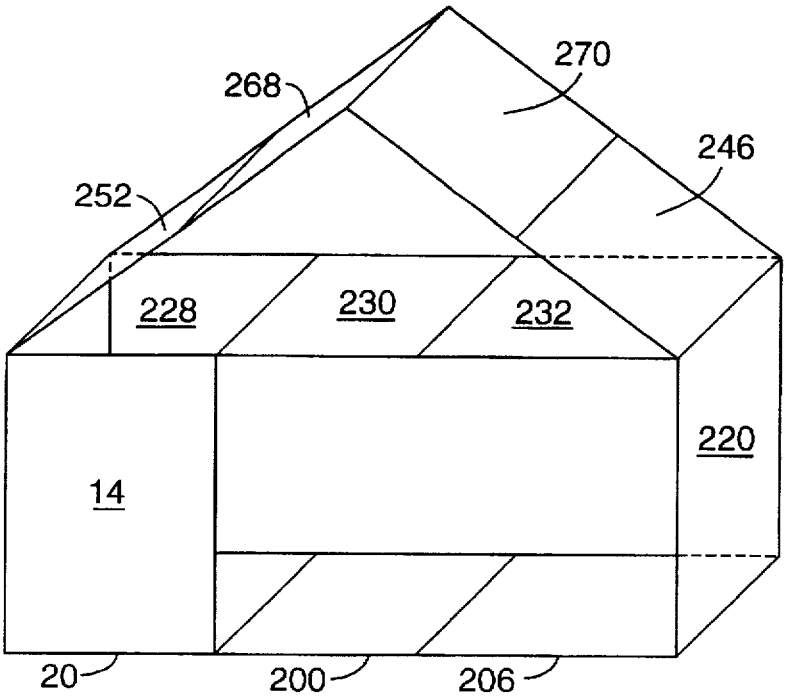
FIG. 25 is a schematic representation of an alternate embodiment of the building module of FIG. 21 shown in the folded position.

Next turning to FIGS. 25 and 26 the building module 10, rather than employing telescopic roof sections, utilizes a third and fourth roof section 268 and 270. The third roof section 268 is pivotally connected along an edge portion 272 to an edge portion 274 of the first roof section 246 for movement between a folded position, FIG. 26, and an unfolded position, FIG. 25. Similarly, the fourth roof section 252 is pivotally connected to the second roof section 254 for movement between a folded position, FIG. 26, and an unfolded position, FIG. 25.

As seen in FIG. 25, when the roof sections are all in their respective unfolded positions, they coact to form a pitched continuous roof.

Referring specifically to FIG. 26, the building module 10 is shown in its collapsed for transport condition. In this position, the first through fourth roof sections 246, 250, 268 and 270, as well as the first through the third ceiling sections 228, 230 and 232 are in a superposed relationship supported by the core section vertical walls 14 and 16.

Figure 27:
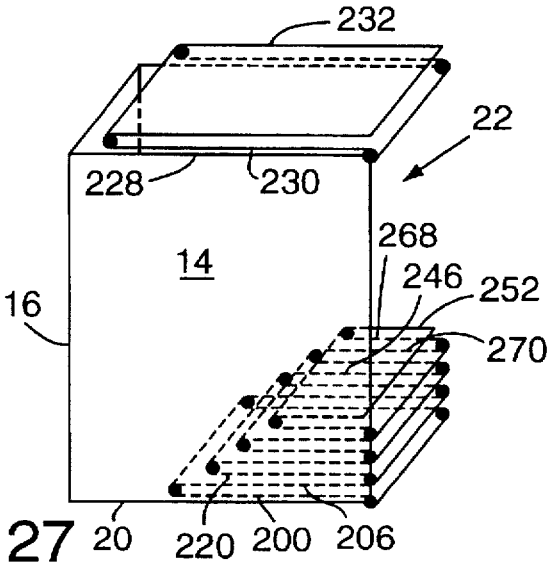
FIG. 27 is a schematic representation of an alternate embodiment of the building module of FIG. 21.

In an alternate embodiment of the present invention shown in FIG. 27, the first roof section 246 is pivotally connected along an edge portion to an edge portion of the substantially vertical wall 220 for movement between a folded and an unfolded position. Likewise, roof section 270 is pivotally connected along an edge portion to an edge portion of roof section 246, roof section 268 is pivotally connected along an edge portion to an edge portion of roof section 270, and roof section 252 is pivotally connected along an edge portion to an edge portion of roof section 268, for movement between folded and unfolded positions. Therefore all of the roof sections along with the substantially vertical wall and the floor sections can pivot in a superposed relationship, into or below the partially enclosed interior area 22. In addition, the ceiling sections 228, 230, 232, all lie in a superposed relationship when in their respective folded positions, supported by the core section vertical walls.

Figure 28:
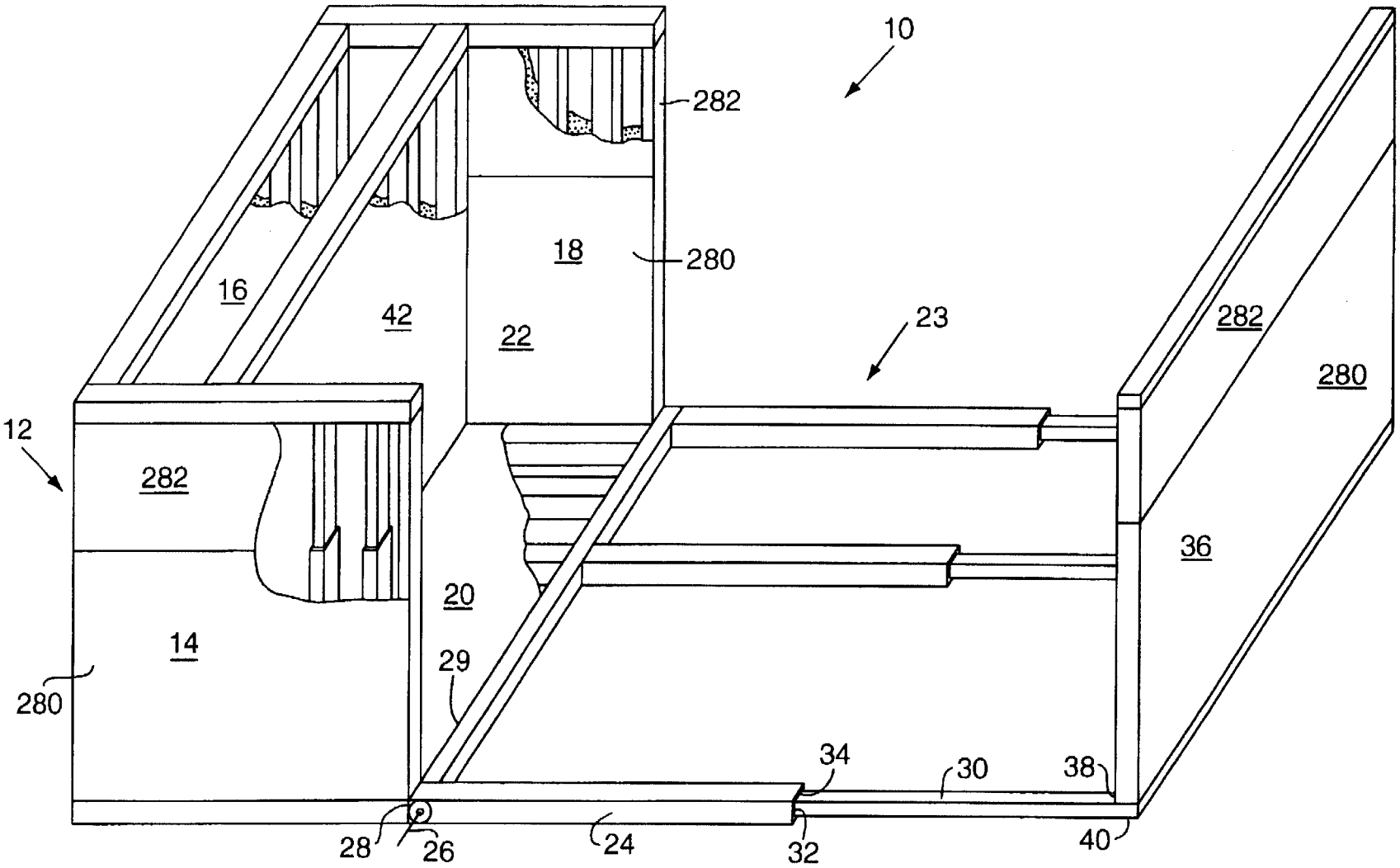
FIG. 28 is a schematic representation of an alternate embodiment of the building module of FIG. 1.

In yet a further embodiment of the present invention, shown in FIG. 28, the vertical longitudinal and lateral side walls of the building module 10, have stationary portions generally designated as 280 and telescopic portions generally designated 282, slidably engaged with the stationary portions for movement between a retracted and an extended position.

Figure 29:
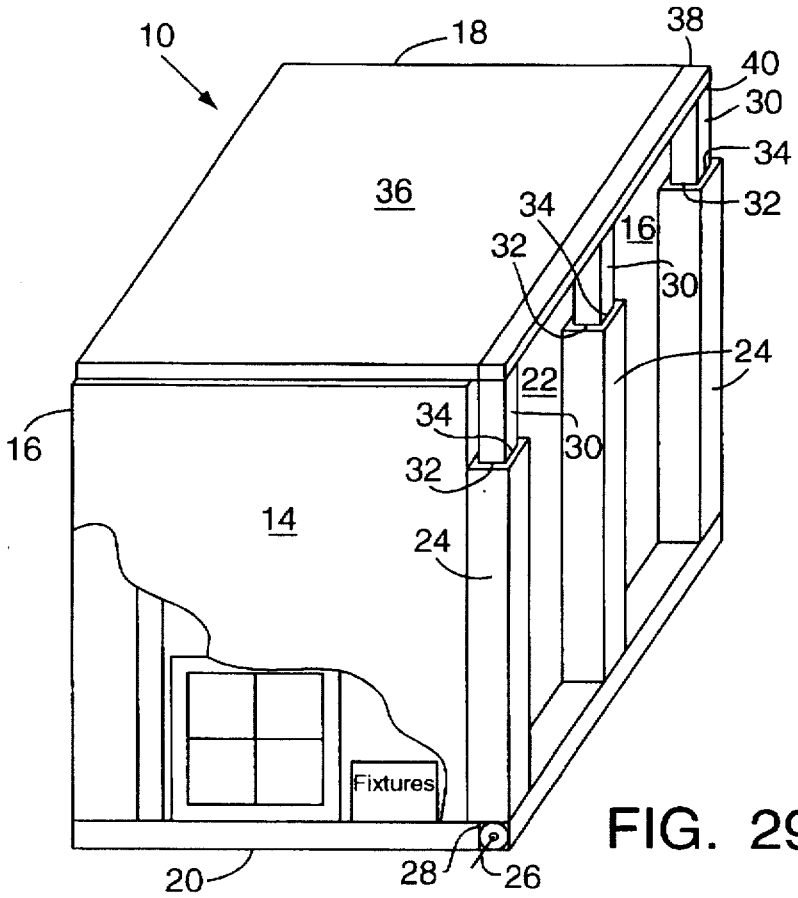
FIG. 29 is schematic representation of the building module of the present invention shown in its collapsed for transport position with building materials stored in the partially enclosed interior area.

Finally, as shown in FIG. 29, the building module 10 can be shipped as a kit containing the necessary materials for construction. When the module is in its collapsed position, the necessary building materials, such as, but not limited to, plumbing fixtures, electrical fixtures, wires, hardware, and conduits can be stored in the partially enclosed interior area. Additionally, exterior and interior walls which may be pivotally attached to the core section vertical walls for movement between stored and assembled positions, as well as windows, and shingles can also be stored within the partially enclosed interior area 22.

While preferred embodiments have been shown and described, various modifications and substitutions may be made without departing from the spirit and scope of the invention. Accordingly, it is to be understood that the present invention has been described by way of example and not by limitation.

I claim:

1. A building module, collapsible for transport and expandable for uses comprising:

a substantially rigid elongated core structure having interconnected upstanding elongated lateral and longitudinal wall sections, a substantially horizontal core floor section, each of said upstanding wall sections being coupled along the length of the wall section at a base portion thereof to said substantially horizontal core floor section, said upstanding wall sections and said core floor section defining at least a partially enclosed interior area; and at least one expandable floor assembly coupled to said core floor section for movement between a contracted and an extended position, the expandable floor assembly comprising:

at least one movable floor section pivotally attached along one edge portion to an edge portion of said core floor section for movement between a folded and an unfolded position;

said at least one movable floor section being substantially vertical and perpendicular to said core floor section in said folded position and substantially in a common plane with said core floor section in said unfolded position; and at least one telescopic floor section slidably engaged with said at least one movable floor section for movement between retracted and extended positions, said telescopic floor section being in said retracted position when said at least one movable floor section is in said folded position, and in its extended position when said at least one movable floor section is in said substantially horizontal position.

2. The building module of claim 1 wherein said building module is of a size and shape when collapsed for transport which complies with the current United States Department of Transportation regulations regarding the maximum standard allowable shipping size for ground transportation.

3. The building module of claim 1 wherein said building module is of a size and shape when collapsed for transport which complies with the current International Standards Organization's code regarding the maximum standard allowable shipping size for ground transportation.

4. The building module of claim 1 wherein said building module is of a size and shape when collapsed for transport which will fit within a shipping container which complies with the current International Standards Organization's code regarding the maximum standard allowable shipping size for shipment by boat.

5. The building module of claim 1 further comprising at least one substantially vertical wall section attached along one edge portion to an edge portion of said at least one telescopic floor section such that when said at least one movable floor section is in said folded position, and said at least one telescopic floor section is in said retracted position, said at least one substantially vertical wall section is located above and supported by said core section vertical walls.

6. The building module of claim 5 further comprising:

a first ceiling section supported by said core structure vertical walls;

a second ceiling section pivotally connected along one edge to an opposite edge of said at least one substantially vertical wall section for movement between a first folded position where said second ceiling section is substantially parallel to and in a side-by-side relationship with said at least one substantially vertical wall section, and a second unfolded position where said second ceiling section is substantially perpendicular to said at least one substantially vertical wall section, said second ceiling section and said at least one substantially vertical wall section being in a superposed relationship with said first ceiling section when said at least one movable floor section is in said folded position.

7. The building module of claim 6 further comprising:

a telescopic ceiling section slidably engaged with said first ceiling section for movement between a retracted position wherein said telescopic ceiling section is positioned within said first ceiling section, and an extended position where said telescopic section is interposed between and slidably engaged with each of said first and second ceiling sections.

8. The building module of claim 6 further comprising:

a first roof section pivotally connected along an edge portion to an edge portion of said first ceiling section for movement between a collapsed position where said first roof section is supported by, said first ceiling section, and an assembled position where said first roof section forms a portion of a pitched roof; and at least a second roof section pivotally connected along an edge portion to said second ceiling section for movement between an assembled position where said second roof section forms another portion of said pitched roof, and a collapsed position where said at least a second roof section is supported by said second ceiling section such that when said at least one movable floor section is in said folded position said first and second ceiling sections, said first and at least a second roof sections, and said vertical wall section all lie in a superposed relationship supported by said core structure vertical walls.

9. The building module of claim 8 further comprising:

a first telescopic roof section slidably engaged with said first roof section for movement between a retracted and extended position; and a second telescopic roof section slidably engaged with said second roof section for movement between a retracted position and an extended position, such that when said first and second telescopic roof sections are in said extended positions and said first and second roof sections are in said assembled positions, a continuous pitched roof is formed.

10. The building module of claim 8 further comprising:

a third roof section pivotally connected along an edge portion to said first roof section for movement between an assembled position and a collapsed position;

said third roof section being in a side-by-side relationship with said first roof section when in said collapsed position;

a fourth roof section pivotally connected along an edge portion to said second roof section for movement between an assembled position, such that when said first, second, third and fourth roof sections are in said assembled positions, a pitched continuous roof is formed, and a collapsed position where said fourth roof section assumes a substantially parallel, side-by-side relationship with said first roof section such that when said at least one movable floor section is in said folded position said first and second ceiling sections, said first, second, third, and fourth roof sections, and said vertical wall section assume a superposed relationship supported by said core structure vertical walls.

11. The building module of claim 1 wherein said at least one movable floor section includes a plurality of floor joists having an interior surface defining an interior area, and said at least one telescopic floor section includes a plurality of elongated floor members having an exterior surface, said floor joist interior area being shaped to slidably receive said elongated floor member exterior surface.

12. The building module of claim 11 wherein said floor joists and said elongated floor members are formed from metal.

13. The building module of claim 7 wherein said first and second ceiling sections include a plurality of ceiling joists having an interior surface defining an interior area, and said telescopic ceiling section includes a plurality of telescopic ceiling members having exterior surfaces, said first and second ceiling section joist interior areas being shaped to slidably receive said telescopic ceiling member exterior surfaces.

14. The building module of claim 13 wherein said ceiling joists and said telescopic ceiling members are formed from metal.

15. The building module of claim 8 wherein said first and second roof sections include a plurality of metal rafters.

16. The building module of claim 9 wherein said first and second roof sections include a plurality of rafters having an interior surface defining an interior area, and said first and second telescopic roof sections include a plurality of telescopic rafter members having exterior surfaces, said first and second roof section rafter interior areas being shaped to slidably receive said telescopic rafter member exterior surfaces.

17. The building module of claim 16 wherein said first and second roof section rafters and said telescopic rafter members are formed from metal.

18. The building module of claim 10 wherein said first, second, third and fourth roof sections include a plurality of rafter members.

19. The building module of claim 18 wherein said first, second, third and fourth roof section rafter members are formed from metal.

20. The building module of claim 1 wherein said at least one expandable floor assembly further includes:

at least one additional movable floor section pivotally attached along one edge portion to an opposite edge portion of said at least one movable floor section for movement about a pivot axis parallel with said edge portions between folded and unfolded positions; and said at least one movable floor section and said at least one additional movable floor section being in a superposed relationship and substantially parallel to said core floor section when in said respective folded positions and substantially in a common plane with said core floor section in said respective unfolded positions.

21. The building module of claim 20 further comprising at least one substantially, vertical wall section pivotally attached along one edge portion to an opposite edge portion of said at least one additional movable floor section for movement between a folded and unfolded position, said at least one movable floor section, said at least one additional movable floor section, and said at least one substantially vertical wall section being in a superposed relationship and substantially parallel to said core floor section when in said respective folded positions and said at least one substantially vertical wall section being substantially perpendicular to said at least one additional movable floor section when said floor sections are in said respective unfolded positions.

22. The building module of claim 1 further comprising at least one substantially vertical wall section pivotally attached along one edge portion to an edge portion of said at least one telescopic floor section for movement between folded and unfolded positions, such that when said at least one movable floor section, and said at least one substantially vertical wall section are in said respective folded positions, and said at least one telescopic floor section is in said retracted position, said at least one substantially vertical wall section is in a superposed relationship with said at least one movable floor section parallel to said core floor section.

23. The building module of claim 21 further comprising:

a first substantially horizontal ceiling section supported by said core section vertical walls;

at least a second ceiling section pivotally connected along an edge portion to an edge portion of said first ceiling section for movement between a folded and an unfolded position;

at least a third ceiling section pivotally connected along an edge portion to an edge portion of said at least a second ceiling section for movement between a folded and an unfolded position;

said second and third ceiling sections being in a superposed relationship with said first ceiling section when in said respective folded positions; and said second and third ceiling sections being in a substantially common plane with said first ceiling section and said at least a third ceiling section being supported along an edge portion by an edge portion of said at least one substantially vertical wall section when said second and third ceiling sections, said floor sections, and said substantially vertical wall section are in said respective unfolded positions.

24. The building module of claim 23 further comprising:

a first roof section pivotally attached along an edge portion to an edge portion of said third ceiling section for movement between a folded and an unfolded position;

at least a second roof section pivotally attached along an edge portion to said first roof section for movement between a folded and an unfolded position; and said first and second roof sections being in a superposed relationship with said first, and said second and third ceiling sections when said roof sections are in said respective folded positions; and said first and second roof sections forming a pitched continuous roof when said floor sections, said substantially vertical wall section, said ceiling sections and said roof sections are in said respective unfolded positions.

25. The building module of claim 24 further comprising:

a third roof section pivotally attached along an edge portion to said second roof section for movement between a folded and an unfolded position;

a fourth roof section pivotally attached along an edge portion to said third roof section for movement between a folded and an unfolded position; and said first, second, third and fourth roof sections being in a forming a pitched continuous roof in said unfolded positions, and assuming a superposed relationship with said ceiling sections in said folded positions.

26. A kit for constructing a building comprising:

at least one building module according to claim 8;

at least one exterior wall located in said partially enclosed interior area when said at least one building module is collapsed for transport, said at least one exterior wall being adapted to be assembled between said at least one vertical wall and said core section vertical lateral walls when said at least one building module is in said expanded position thereby defining an elongated partially enclosed interior area;

at least one door located in said partially enclosed interior area when said at least one building module is collapsed for transport, said at least one door adapted to be assembled into said at least one exterior wall when said at least one building module is in said expanded position.

27. The kit of claim 26 further including at least one interior wall located in said partially enclosed interior area when said building module is collapsed for transport, said interior wall adapted to be assembled within said elongated partially enclosed interior area when said at least one building module is in said expanded position.

28. A The kit of claim 26 further including at least one window located in said partially enclosed interior area when said building module is collapsed for transport, said window adapted to be assembled in said exterior wall.

29. The kit of claim 26 further including electrical fixtures, wires, hardware, and conduits located in said partially enclosed interior area when said building module is collapsed for transport, for assembly into said building when said building module is in said expanded position.

30. The kit of claim 26 further including plumbing fixtures, hardware, and conduits located in said partially enclosed interior area when said building module is collapsed for transport, for assembly into said building when said building module is in said expanded position.

31. The kit of claim 26 further including exterior shingles located in said partially enclosed interior area when said building module is collapsed for transport, for attachment to said building when said building module is in said expanded position.

32. The building module of claim 1 wherein said core structure vertical wall sections are comprised of stationary portions and vertically telescopic portions slidably engaged with said stationary portions for movement between an extended and retracted position.

33. The building module of claim 1 wherein said substantially vertical wall section includes a stationary portion and at least one telescopic portion slidably engaged with said at least one stationary portion for movement between an extended and retracted position.

34. The building module of claim 1 further comprising:

at least one movable vertical wall section pivotally attached along an edge portion to an edge portion of at least one of said core section longitudinal walls for movement between a transport position wherein said movable vertical wall section is located within said partially enclosed interior area when said building module is collapsed for transport, and an assembled position where said movable vertical wall section is in a substantially common plane with at least one of said core section longitudinal walls when said building module is expanded for use.

35. The building module of claim 34 wherein said movable vertical wall section is defined by a stationary portion and a telescopic portion slidably engaged with said stationary portion.

36. The building module of claim 21 further comprising:

a first ceiling section located on and supported by said core section vertical walls;

a second ceiling section pivotally attached along an edge portion to an opposite edge portion of said first ceiling section for movement between a folded and unfolded position;

a third ceiling section pivotally attached along an edge portion to an opposite edge portion of said second ceiling section for movement between a folded and unfolded position;

a first roof section pivotally attached along an edge portion to an opposite edge portion of said substantially vertical wall for movement between a folded and unfolded position;

a second roof section pivotally attached along an edge portion to an opposite edge portion of said first roof section for movement between a folded and unfolded position;

a third roof section pivotally attached along an edge portion to an opposite edge portion of said second roof section for movement between a folded and unfolded position;

a fourth roof section pivotally attached along an edge portion to an opposite edge portion of said third roof section for movement between a folded and unfolded position;

said ceiling sections being in a substantially common plane with said third ceiling section being supported by said substantially vertical wall, and said roof sections forming a continuous pitched roof when all of said section are in said respective unfolded positions;

said first roof sections, said substantially vertical wall section, and said floor sections all being in a superposed relationship, substantially parallel to said core floor section when in said respective folded positions; and said ceiling sections being in a superposed relationship, supported by said core section vertical walls when in said respective folded positions.

* * * * *